US007004726B2

(12) United States Patent
Kuo

(10) Patent No.: US 7,004,726 B2
(45) Date of Patent: Feb. 28, 2006

(54) FAN FOR COOLING A COMPUTER

(75) Inventor: Yi-Lung Kuo, Keelung (TW)

(73) Assignee: Shuttle, Inc., (TW)

( * ) Notice: Subject to any disclaimer, the term of this patent is extended or adjusted under 35 U.S.C. 154(b) by 0 days.

(21) Appl. No.: 10/783,953

(22) Filed: Feb. 20, 2004

(65) Prior Publication Data

US 2004/0228728 A1 Nov. 18, 2004

Related U.S. Application Data

(60) Provisional application No. 60/456,432, filed on Mar. 20, 2003.

(51) Int. Cl.
*F04D 29/70* (2006.01)

(52) U.S. Cl. ..... 416/247 R; 415/220

(58) Field of Classification Search ..... 415/211.2, 415/220, 213.1, 208.2; 416/247 R
See application file for complete search history.

(56) References Cited

U.S. PATENT DOCUMENTS

| | | | | |
|---|---|---|---|---|
| 2,176,325 | A * | 10/1939 | Bretzlaff et al. | 416/238 |
| 2,948,518 | A | 8/1960 | Kraus | |
| 4,643,245 | A | 2/1987 | Smoot, III et al. | |
| 5,270,572 | A | 12/1993 | Nakajima et al. | |
| 5,390,734 | A | 2/1995 | Voorhes et al. | |
| 5,446,619 | A | 8/1995 | Madsen et al. | |
| 5,473,507 | A | 12/1995 | Schwegler et al. | |
| 5,505,533 | A | 4/1996 | Kammersqard et al. | |
| 5,586,865 | A | 12/1996 | Yin | |
| 5,600,538 | A | 2/1997 | Xanthopoulos | |
| 5,684,674 | A | 11/1997 | Yin | |
| 5,691,883 | A | 11/1997 | Nelson | |
| 5,701,231 | A | 12/1997 | Do et al. | |
| 5,934,368 | A | 8/1999 | Tanaka et al. | |
| 5,964,279 | A | 10/1999 | Mochizuki et al. | |
| 5,982,616 | A | 11/1999 | Moore | |
| 6,034,870 | A | 3/2000 | Osborn et al. | |
| 6,094,345 | A | 7/2000 | Diemunsch | |
| 6,094,347 | A | 7/2000 | Bhatia | |
| 6,134,108 | A | 10/2000 | Patel et al. | |
| 6,206,633 | B1 * | 3/2001 | Nakamura et al. | 415/151 |
| 6,299,408 | B1 | 10/2001 | Bhatia | |
| 6,330,155 | B1 | 12/2001 | Remsburg | |
| 6,407,916 | B1 | 6/2002 | Konstad | |
| 6,418,018 | B1 | 7/2002 | Lo | |
| 6,459,576 | B1 | 10/2002 | Bhatia et al. | |
| 6,496,368 | B1 * | 12/2002 | Jui-Yuan | 361/697 |
| 6,525,936 | B1 | 2/2003 | Beitelmal et al. | |
| 6,813,149 | B1 | 11/2004 | Faneuf et al. | |
| 6,896,095 | B1 * | 5/2005 | Shah et al. | 181/198 |
| 2001/0030851 | A1 | 10/2001 | Usui et al. | |

OTHER PUBLICATIONS

CENGEL, Y., Heat Transfer: A Practical Approach, McGraw-Hill, 1998, p. 905, p. 167.
Intel ATX Specification 2.01, Section 1, 1996, pp. 1-27.
STEINBERG, D., Cooling Techniques for Electronic Equipment, John Wiley & Sons, Inc., 1991, p. 158, p. 233.

* cited by examiner

*Primary Examiner*—Edward K. Look
*Assistant Examiner*—Devin Hanan
(74) *Attorney, Agent, or Firm*—Fenwick & West LLP

(57) ABSTRACT

A fan assembly includes a fan mounted within a housing that features an inward concave arrangement for an inner face of its housing to reduce the distance between the housing and a center shaft of the fan blades. In this way, fan vibration and noise can be reduced.

7 Claims, 2 Drawing Sheets

FAN FOR COOLING A COMPUTER

CROSS REFERENCE TO RELATED APPLICATIONS

This application claims the benefit of U.S. Provisional Application No. 60/456,432, filed Mar. 20, 2003, which is hereby incorporated in its entirety by reference.

BACKGROUND

1. Field of the Invention

The invention relates to cooling devices for computers, and in particular to cooling fans configured to remove heat generated by components within a personal computer.

2. Background of the Invention

Computers are widely used in our lives. Development of materials science and electronics technologies has boosted the speed and lowered the dimensions of microprocessors in recent years. This has enabled computer manufacturers to develop and launch more powerful computers having smaller sizes. However, computer components cased in a chassis—motherboards in particular—generate more heat as they operate at higher speeds. This additional heat generated must be removed from the chassis with cooling fans or other cooling means.

A traditional cooling fan or fan assembly for a personal computer is shown in FIG. 1. In this traditional cooling fan, fan blades 10 inside the outer frame 20 are driven by an output shaft of a motor to generate a flow of air. To create ventilation to allow the exchange of heat with the airflow, openings are formed in the frame 20 to create air channels 30 through the fan assembly. The center of the frame 20 includes a block 40, here having a circular shape, which is approximately centered on the axis of rotation of the fan. When the blades 10 rotate during operation of the fan, air is forced through the air channels 30, which lie on the same plane as the inner face of the frame 20. This fan assembly is then attached to a chassis of a computer, where the chassis includes a number of air channels to allow a flow of air through the chassis and fan.

Although the fan of FIG. 1 can offer a basic cooling functionality, this fan generates a near elliptic disturbed flow zone 50 in front of the near circular block 40 due to the blocking of the airflow by the block 40, as shown in FIG. 3. Moreover, the distance between the block 40 and the output shaft 60 of the motor (or blade trunnion) is about the same as that between the frame 20 and the output shaft 60, which can cause blade vibration and hence an undesirable noise.

SUMMARY OF THE INVENTION

To improve upon existing cooling fan assemblies for computers, a fan assembly features an inward concave arrangement for an inner face of its housing to reduce the distance between the housing and a center shaft of the fan blades. In this way, a region of disturbed air emerging from the fan, and thus fan vibration and noise, can be reduced.

In one embodiment, a fan assembly includes a fan mounted within a housing, where the housing has an inner face towards which the fan is oriented to blow air. This inner face has an inward concave shape so that a central portion of the inner face is nearer to the fan than an outer portion of the inner face. The fan assembly can be attached to a computer chassis that has corresponding openings to allow for air to flow through and thus remove heat from the computer.

DETAILED DESCRIPTION OF THE PREFERRED EMBODIMENTS

Figure 1:
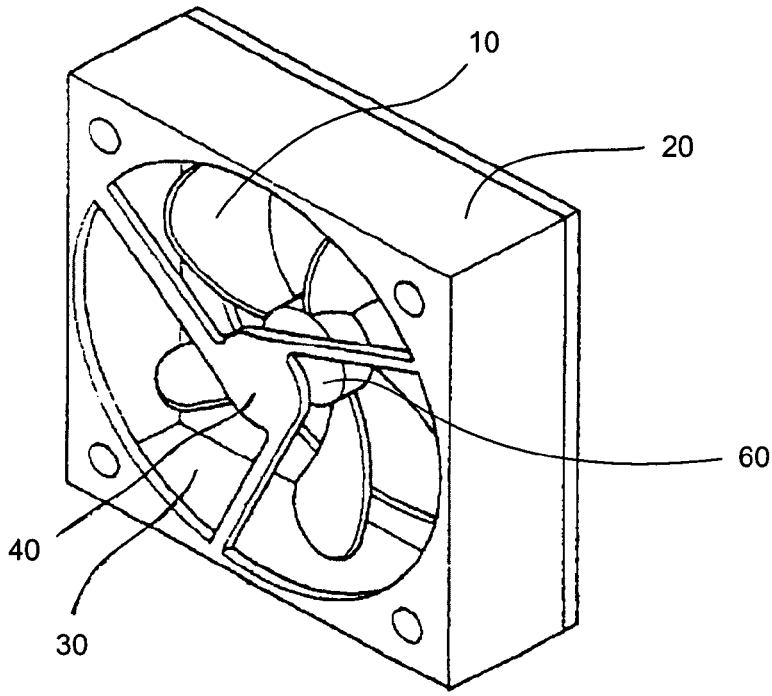
Fig. 1 (prior art)
FIG. 1 shows an existing fan assembly for personal computers.
Figure 2:
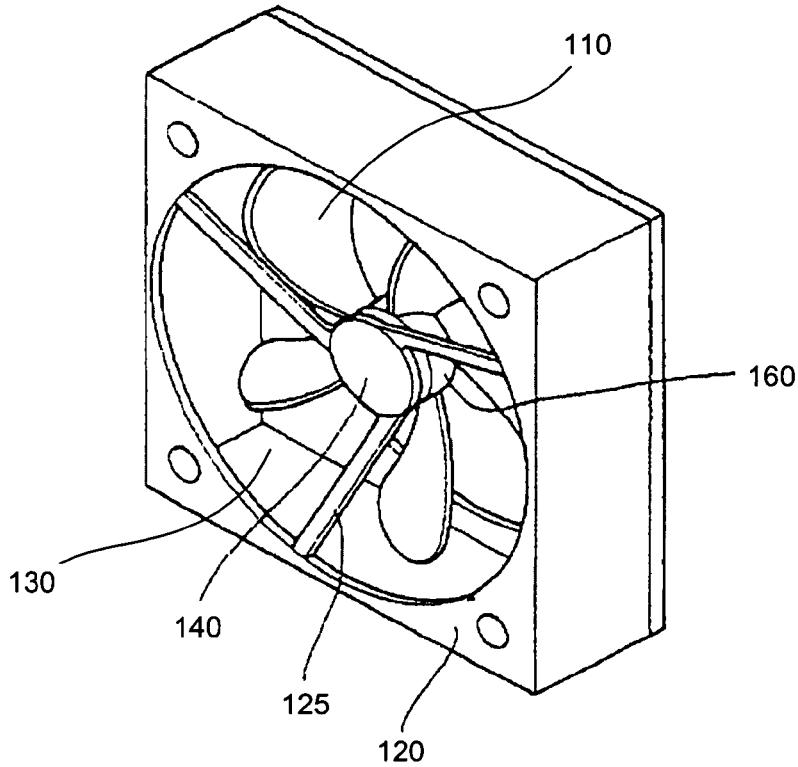
FIG. 2 shows a fan assembly for cooling a computer in accordance with an embodiment of the invention.

FIG. 2 shows a cooling fan assembly for use with a personal computer or other electronic device that requires heat removal from its chassis. The fan assembly includes a fan 110 configured to be driven by a blade rotor 160 and mounted within a housing 120. The housing 120 includes an inner face 125 that has a number of openings 130 therein and a block 140 that is located about the axis of rotation of the fan 110. The inner face 125 of the housing 120 is arranged in an inward concave shape, creating an inward slope between the outer housing 120 and inner face 125 thereof. In this way, the distance between the central block 140 and the blade rotor 160 is less than that between the rest of the housing 120 and the blade rotor 160, as measured normal to the plane of the inner face 125. This gives the housing 120 a vertically concave architecture and a plane surface on the central circular block 140.

Figure 4:
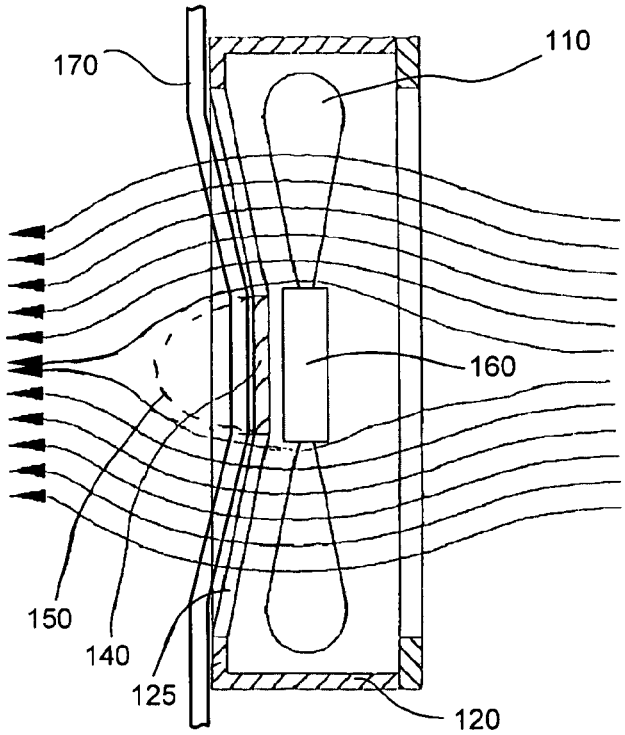
FIG. 4 illustrates a side view of a fan in accordance with an embodiment of the invention, showing the disturbed flow zone caused by the fan.

As shown in FIG. 4, one embodiment of the fan assembly is configured to direct air through the openings 130 in the inner face 125 of its housing 120. The rotating blades of the fan 110 force air through the fan assembly into or out of the attached chassis. As the figure illustrates by way of arrows to indicate the direction of airflow, the fan creates a disturbed flow zone 150 in the airflow that emerges from the inner face 125 of the housing 120. This disturbed flow zone 150 is due to the blocking of the airflow by parts of the housing 120, including the block 140.

Figure 3:
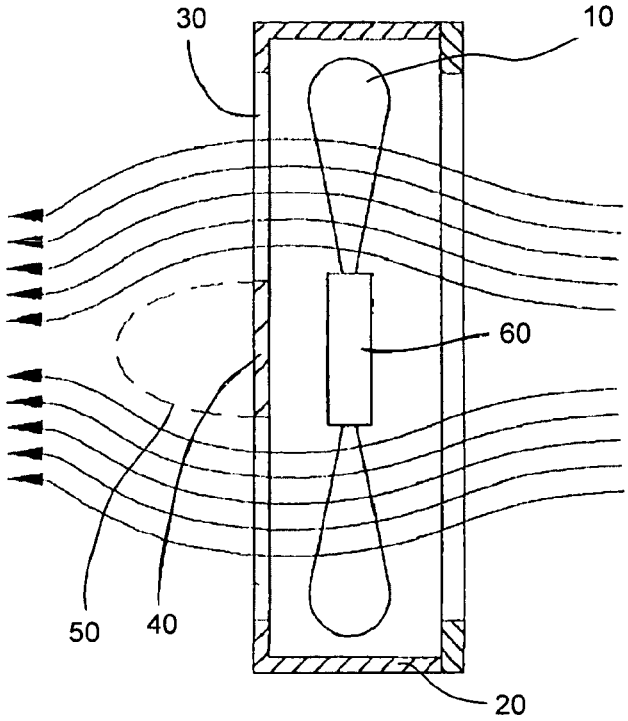
Fig. 3 (prior art)
FIG. 3 illustrates a side view of an existing cooling fan, showing the disturbed airflow zone caused by the fan.

The length of the disturbed flow zone 150 depends on the central block 140 and the configuration of the inner face 125. The disturbed flow zone 150 in front of the central block 140, as shown in FIG. 4, is similar to that of existing fan assemblies, as shown in FIG. 3, but the concave architecture of the inner face 125 and the central block 140 shortens the extension of the zone 150. It has been found that shortening the disturbed flow zone 150 lowers the noise of the fan assembly. Moreover, this effect is true for either direction of airflow.

In one embodiment, the fan assembly is attached to a chassis 170 of a personal computer or other electronic equipment for which removal of hot air is desired. The chassis 170 includes one or more openings to allow airflow directed by the fan assembly to pass through the chassis 170. At least some of these openings in the chassis 170 correspond to the openings 130 in the housing 120 of the fan assembly. In one embodiment, the chassis 170 is designed in an inward concave arrangement to match the central block 140 and/or inner face 125 of the fan assembly's housing 120. This helps shorten extension of the disturbed flow 150 out of the output face and the distance between the chassis 170 and the fan shaft to lessen the resultant vibration and noise. In alternate embodiments, all or part of the housing 120 for the fan can be integral with or formed by portions of the chassis 170.

The foregoing description of the embodiments of the invention has been presented for the purposes of illustration and description. It is not intended to be exhaustive or to limit the invention to the precise forms disclosed. Persons skilled in the relevant art can appreciate that many modifications and variations are possible in light of the above teaching. It is therefore intended that the scope of the invention be limited not by this detailed description, but rather by the claims appended hereto.

I claim:

1. A fan assembly comprising:

a fan; and a housing for the fan, the housing having an inner face towards which the fan is oriented to blow air, wherein the inner face has an inward concave shape so that a central portion of the inner face is nearer to the fan than an outer portion of the inner face;

wherein the fan assembly is attached to a chassis of a computer, the chassis having one or more openings at least partially aligned with one or more openings in the inner face of the housing, thereby allowing air to flow through the chassis during operation of the fan, and wherein the chassis has a concave architecture to match the inner face of the housing.

2. The fan assembly of claim 1, wherein the chassis forms at least a portion of the housing.

3. A personal computer a cooling apparatus for comprising:

a chassis having one or more openings for allowing an airflow therethrough, where at least a portion of the chassis that has the openings is concave;

a fan housing comprising an inner face having one or more openings for allowing an airflow therethrough, where at least a portion of the inner face that has the openings is concave, the fan housing mounted in relation to the chassis so that the concave portion of the chassis and the concave portion of the inner face are aligned at least in part; and a fan mounted within the fan housing and configured to direct and airflow through the openings of the fan housing and of the chassis.

4. The cooling apparatus of claim 3, wherein the concave portion of the chassis is integral with the concave portion of the inner face of the fan housing.

5. The cooling apparatus of claim 3, wherein the fan housing is mounted to the chassis so that a central portion of the concave portion of the chassis is nearer to the fan than an outer potion of the concave portion of the inner face of the fan housing.

6. The cooling apparatus of claim 3, wherein the fan is configured to direct air towards the inner face of the fan housing.

7. The cooling apparatus of claim 3, wherein the fan is configured to direct air away from the inner face of the fan housing.

* * * * *